US010609966B2

(12) United States Patent
Huffa et al.

(10) Patent No.: US 10,609,966 B2
(45) Date of Patent: Apr. 7, 2020

(54) PRESSURE-DISTRIBUTING UNDERGARMENT

(71) Applicant: LULULEMON ATHLETICA CANADA INC., Vancouver (CA)

(72) Inventors: Bruce Huffa, Vancouver (CA); Kristen Barnes, Vancouver (CA); Erica Buckeridge, Vancouver (CA); Yogendra Dandapure, Vancouver (CA)

(73) Assignee: LULULEMON ATHLETICA CANADA INC. (CA)

( * ) Notice: Subject to any disclaimer, the term of this patent is extended or adjusted under 35 U.S.C. 154(b) by 140 days.

(21) Appl. No.: 15/720,555

(22) Filed: Sep. 29, 2017

(65) Prior Publication Data

US 2019/0098940 A1 Apr. 4, 2019

(51) Int. Cl.

| | |
|---|---|
| ***A41C 3/00*** | (2006.01) |
| ***A41C 3/12*** | (2006.01) |
| *A41D 27/02* | (2006.01) |
| *A41C 3/08* | (2006.01) |

(52) U.S. Cl.

CPC ..... *A41C 3/0057* (2013.01); *A41C 3/124* (2013.01); *A41C 3/126* (2013.01); *A41C 3/0028* (2013.01); *A41C 3/08* (2013.01); *A41D 27/02* (2013.01)

(58) Field of Classification Search

CPC ..... A41C 3/0057; A41C 3/124; A41C 3/126
USPC ..... 450/30–33, 36
See application file for complete search history.

(56) References Cited

U.S. PATENT DOCUMENTS

| | | | | |
|---|---|---|---|---|
| 5,275,022 | A * | 1/1994 | Stoll | D04B 1/126 66/189 |
| 7,435,155 | B2 | 10/2008 | Reinisch et al. | |
| 7,833,082 | B2 | 11/2010 | Bugada | |
| 8,128,457 | B2 | 3/2012 | Reinisch et al. | |
| 8,480,452 | B2 | 7/2013 | Reinisch et al. | |
| 8,690,634 | B2 | 4/2014 | Heath et al. | |
| 8,915,764 | B2 | 12/2014 | Scott et al. | |
| 9,480,287 | B2 * | 11/2016 | Black | A41C 3/0057 |
| 9,538,794 | B2 * | 1/2017 | Turlan | A41C 3/0007 |
| 2003/0082994 | A1 * | 5/2003 | Mitchell | A41C 3/0007 450/74 |
| 2003/0171066 | A1 * | 9/2003 | Mitchell | A41C 3/0014 450/66 |
| 2004/0172981 | A1 * | 9/2004 | Okamoto | D04B 7/26 66/8 |
| 2006/0240743 | A1 * | 10/2006 | Mitchell | A41C 3/0014 450/1 |
| 2009/0081924 | A1 * | 3/2009 | Puyaubreau | A41C 3/0057 450/39 |
| 2009/0265831 | A1 * | 10/2009 | Hendrickson | A41C 3/04 2/104 |

(Continued)

FOREIGN PATENT DOCUMENTS

EP 2153739 B1 10/2012

*Primary Examiner* — Gloria M Hale
(74) *Attorney, Agent, or Firm* — Bracewell LLP

(57) ABSTRACT

This invention relates to undergarments for use in active environments, where the wearer of such an undergarment is engaged in an activity that results in accelerating movements. In some preferred embodiments, these undergarments may be athletic or sports bras that redirect momentum related to a wearer's accelerating movements, for example, during exercise.

20 Claims, 11 Drawing Sheets

(56) References Cited

U.S. PATENT DOCUMENTS

| | | | | |
|---|---|---|---|---|
| 2010/0068972 | A1* | 3/2010 | Hendrickson | A41C 3/04 450/36 |
| 2011/0212668 | A1* | 9/2011 | Mitchell | A41C 3/0014 450/86 |
| 2012/0122370 | A1* | 5/2012 | Heath | A41C 3/0057 450/80 |
| 2016/0227846 | A1 | 8/2016 | Funk-Danielson et al. | |
| 2016/0360801 | A1 | 12/2016 | Sze et al. | |
| 2017/0119063 | A1 | 5/2017 | Diaz et al. | |
| 2017/0290376 | A1 | 10/2017 | Maheshwari et al. | |
| 2018/0035724 | A1 | 2/2018 | Blibech | |
| 2018/0242653 | A1 | 8/2018 | Brandt et al. | |

* cited by examiner

Stretching Force (kgf)

| | 10% | 30% | 50% | 80% |
|---|---|---|---|---|
| 103 | 0.0259 | 0.1501 | 0.2744 | 0.7256 |
| 104 | -0.0278 | 0.2498 | 0.4689 | 0.9655 |
| 108 | 0.0328 | 0.3075 | 0.5494 | 1.0700 |
| 102 | 0.0018 | 0.0346 | 0.2043 | 0.3139 |
| 101 | -0.0120 | 0.2112 | 0.3478 | 0.7840 |
| 120 | 0.0619 | 0.2035 | 0.3138 | 0.6083 |
| 121 | -0.0019 | 0.1952 | 0.3319 | 0.6492 |
| 122 | 0.1681 | 0.4211 | 0.6060 | 1.0100 |
| 111 | 0.0898 | 0.3644 | 0.5767 | 1.0600 |
| 106 | 0.0615 | 0.2432 | 0.3894 | 0.6881 |
| 107 | 0.0236 | 0.2179 | 0.3894 | 0.8205 |
| Mean | 0.0385 | 0.2362 | 0.4047 | 0.7908 |

FIG. 2

PRESSURE-DISTRIBUTING UNDERGARMENT

FIELD OF INVENTION

This invention relates to undergarments for use in active environments, where the wearer of such an undergarment is engaged in an activity that results in accelerating movements. In some preferred embodiments, these undergarments may be athletic or sports bras that redirect momentum related to a wearer's accelerating movements, for example, during exercise.

BACKGROUND OF THE INVENTION

Typical athletic or sports bras are designed to restrict the movement of breast tissue related to high-impact exercise by uniformly compressing the breast tissue to the wearer's chest. While the uniform compression effected by a typical athletic or sports bra may provide adequate movement management of the breast tissue, this compression can also be uncomfortable for the wearer because it does not effectively distribute the pressure around the wearer's torso. This discomfort is typically experienced around the wearer's back and shoulders. A typical athletic or sports bra completely captures and compresses the wearer's breast tissue to the wearer's chest, and is not designed to account for any specific movement or acceleration direction of the breast tissue resulting from the wearer's activity. By failing to provide precise management of the breast tissue, and failing to distribute pressure in more comfortable fashion, a typical athletic or sports bra does not effectively maximize the balance between maintaining the comfort of the wearer and managing movement of the wearer's breast tissue.

There exists a need for an undergarment that provides more precise management of the acceleration and movement of breast tissue during high-impact exercise, while distributing pressure in a way that is more comfortable for the wearer of the undergarment.

SUMMARY OF THE INVENTION

The present invention provides an undergarment that distributes pressure in a way that is comfortable for the wearer while also effectively managing and reducing movement and acceleration of the wearer's breast tissue. In some preferred embodiments, the undergarment comprises at least two substantially decoupled layers that may be fastened together at a number of discrete points.

In some preferred embodiments of the invention, the undergarment is comprised of structural pieces that are formed using three-dimensional knitting techniques. These techniques may include flat-bed knitting, or V-bed knitting that allows for seamless transitions between structures and requires minimal additional sewing after the primary knitting. These seamless transitions allow for strategic arrangement of straps that can provide a more comfortable distribution of load pressure in multiple directions across the wearer's shoulders and back while balancing distributing of the breast tissue along the framework of the undergarment. In effect, these seamless transitions allow the breast tissue to be anchored from above and below in a balanced distribution with respect to the wearer's back and shoulders, providing comfortable support to the wearer. Furthermore, flat bed knitting allows the undergarment to be shaped with a finished knit in edge so that minimal edge finishing after construction of the undergarment. In other embodiments the undergarment may be constructed using narrow fabric manufacturing techniques including joining together knits and wovens to arrive at the desired undergarment properties. In some embodiments, the undergarment may also be constructed using traditional knitting and weaving techniques. When these traditional techniques are employed, the pieces may be joined together to form the undergarment structure and desired properties. These traditionally constructed pieces may also be joined using sewing or bonding techniques. This traditionally constructed embodiment may also be incorporated into a basic bra made of knit or woven fabrics, or may be worn above a basic bra for additional support.

BRIEF DESCRIPTION OF THE DRAWINGS

The accompanying drawings are fully incorporated in, and form part of, this specification, and illustrate embodiments of the invention that, together with the description, serve to explain principles of the invention:

FIG. 2 is a table showing the modulus of the pressure-distributing undergarment depicted in FIGS. 1A, 1B, and 1C, for different percentage extensions at identified locations;

DETAILED DESCRIPTION

Reference will now be made in detail to embodiments of the invention, examples of which are illustrated in the accompanying drawings. While the invention is described in conjunction with these embodiments, it will be understood that the descriptions herein are not intended to limit the invention to these embodiments. On the contrary, the invention is intended to cover alternatives, modifications, and equivalents that may be included within the spirit and scope of the invention as defined by the appended claims. Detailed description of components that are well known in the art may be omitted if that detailed description would confuse or obscure the description of the embodiments of the present invention.

Figure 1A:
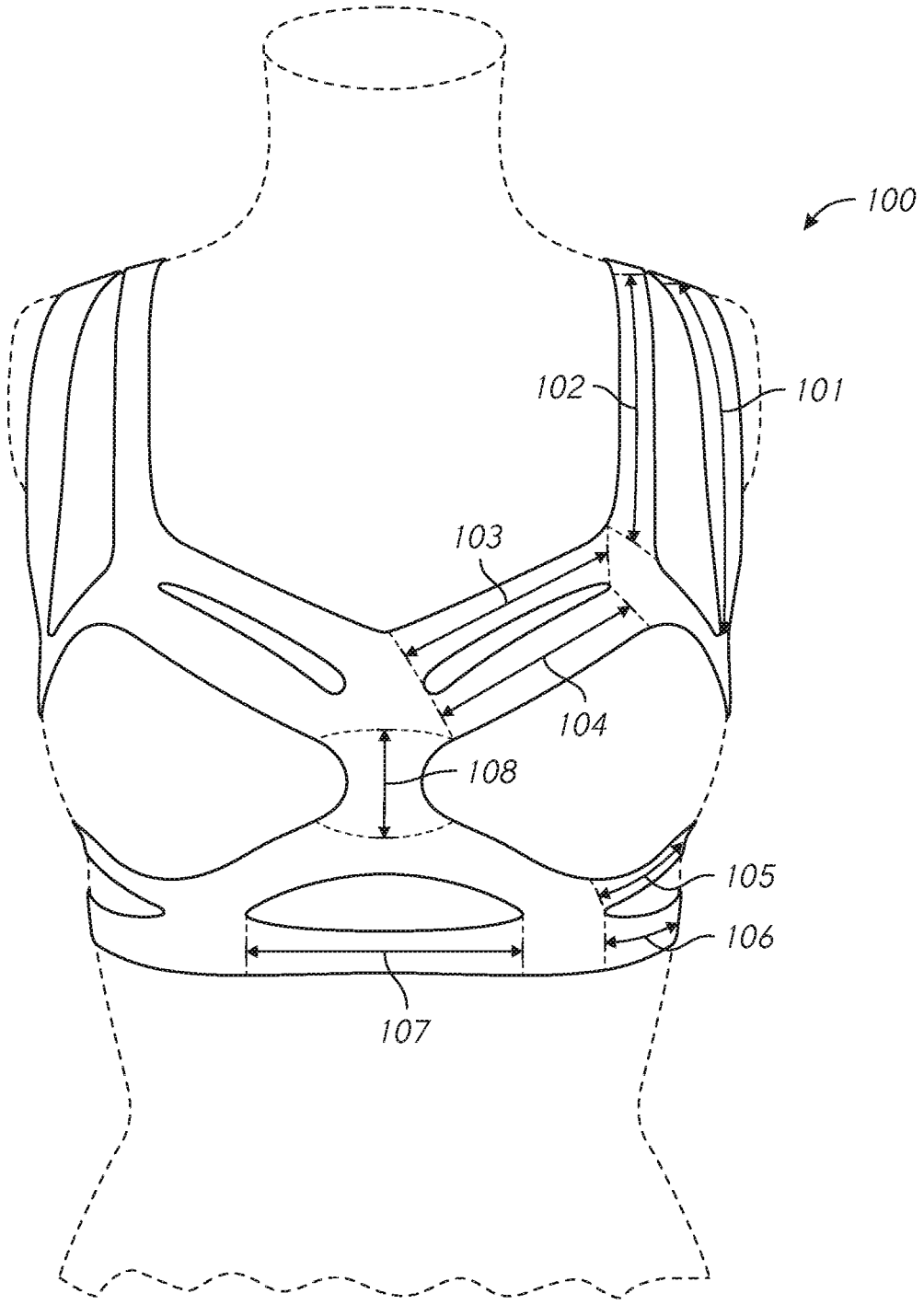
FIGS. 1A, 1B, and 1C depict an example embodiment of a pressure-distributing undergarment according to the invention.
Figure 1B:
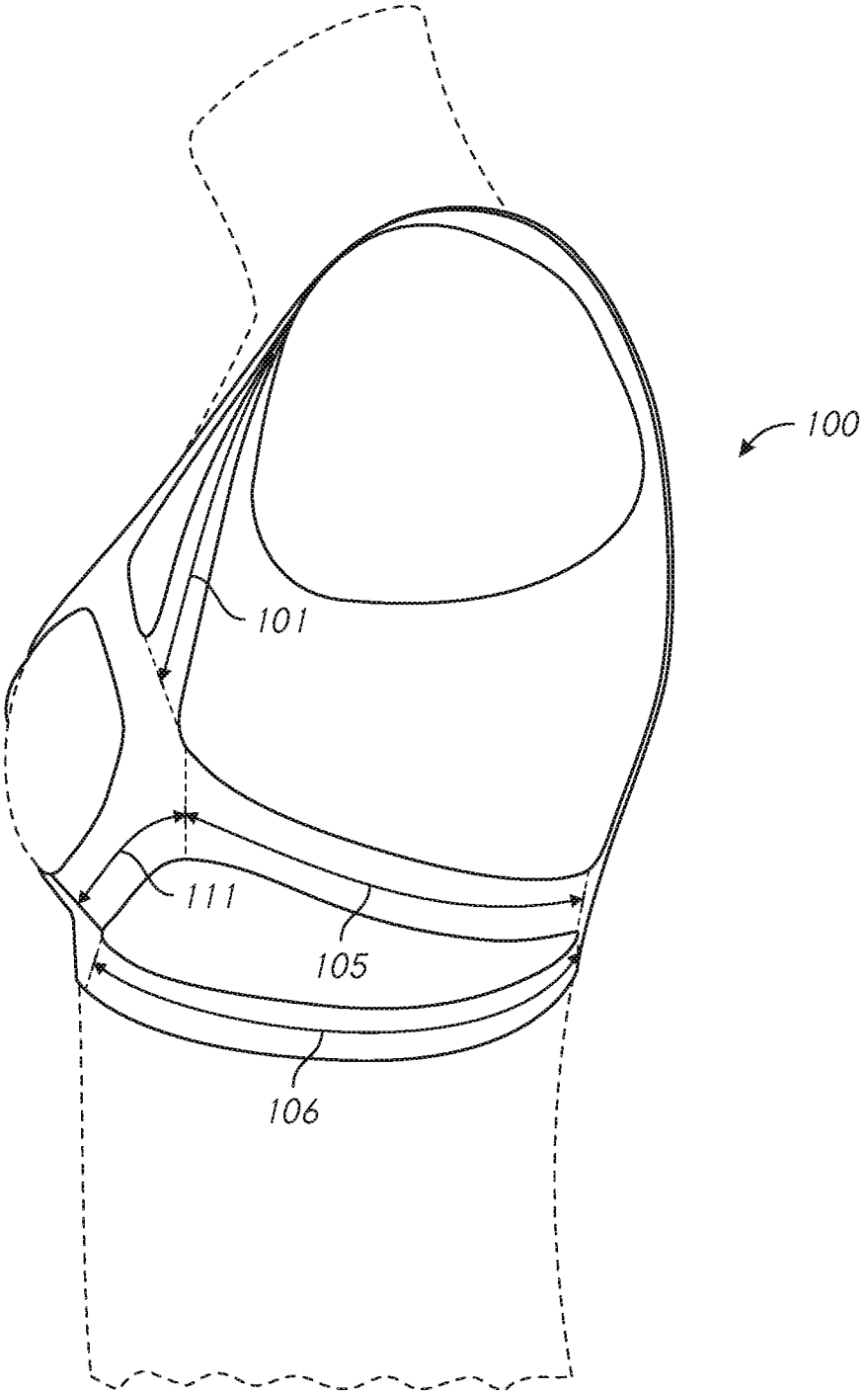
Figure 1C:
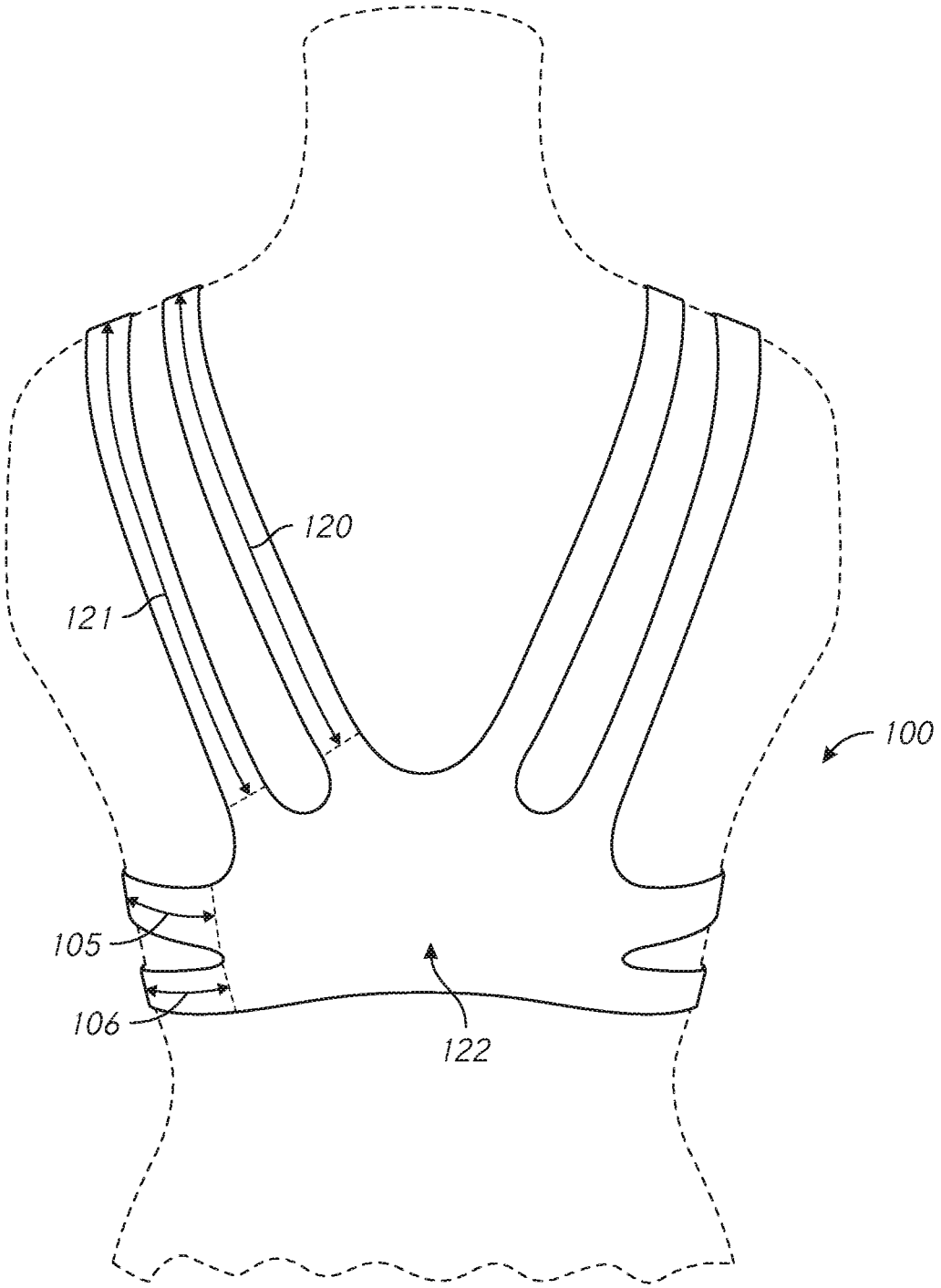

FIGS. 1A, 1B, and 1C depict front, side, and back perspectives of an example embodiment of a pressure-distributing undergarment 100 according to the invention. Pressure-distributing undergarment 100 includes outer shoulder strap 101, inner shoulder strap 102, upper chest band 103, lower chest band 104, upper base band 105, lower base band 106, center base band 107, front center piece 108, side wing 111, inner back strap 120, outer back strap 121, and back center piece 122. The components of pressure-distributing undergarment 100 may be constructed as a single piece through a three-dimensional knitting process. This knitting process allows for an undergarment that requires minimal seams, finishing, and edge stitching, which is ultimately more comfortable for the wearer than an undergarment made through traditional cut-and-sew techniques. The knit construction is also designed to allow the structure of the pressure-distributing undergarment to provide decoupled movement of the breasts such that each breast can move independently in response to the wearer's movements. As will be described in later embodiments, in order to provide improved performance, pressure-distributing undergarment 100 may be used by the wearer in combination with a secondary undergarment that provides low to medium support. This secondary undergarment may be attached to the pressure-distributing undergarment at several key structural points, but the two undergarments should be substantially decoupled, so that the undergarments move independently and allow the breast tissue to also move independently.

In some embodiments, pressure values at outer shoulder strap 101, inner shoulder strap 102, upper base band 105, and lower base band 106 should measure less than or equal to 10 mmHg, for optimal comfort of the wearer. The pressure values may vary depending on the size, configuration, and construction of the undergarment. Limiting the pressure at these bands and straps of the undergarment minimizes the wearer's perceived distractions while allowing the load to be distributed effectively across the wearer's torso.

As depicted in FIG. 1A, rather than being positioned straight across the top of the breast tissue, upper chest band 103 and lower chest band 104 are positioned to move around the top of the breast tissue so that the bands anchor the root of the breast tissue—the area where the breast tissue attaches to the torso. In this position, the bands are more effective at controlling accelerating movements of the breast tissue in the upward direction, than when material is placed straight across the chest.

Similarly, upper base band 105 is designed to provide support around the underside of the root of the wearer's breast tissue, and thereby limit accelerating movements in the downward direction. Lower base band 106 and center band 107 provide support for upper base band 105.

As depicted in FIG. 1B, outer strap 101 and upper base band 105 meet at the side of the breast at side wing 111. This provides support at the side of the base of the breast tissue to limit accelerating movements in a side-to-side direction.

As depicted in FIG. 1C, inner back strap 120, outer back strap 121, upper base band 105, and lower base band 106 are all joined at back center piece 122.

In some embodiments, the pressure-distributing undergarment has a modulus that varies depending upon location on the undergarment, and depending on how far the undergarment is extended. The variation of the modulus values across the pressure-distributing undergarment contributes to its ability to control accelerating movements of the wearer's breast tissue. For example, in one embodiment, the lowest modulus values of the pressure-distributing undergarment are located at the under band and shoulder straps, whereas segments of increased modulus values encapsulate the breast tissue along the lateral borders and over the top of the breast. FIG. 2 contains a table that relates the stretching force at identified locations for different extension lengths.

FIG. 2 depicts a table showing the modulus of an example pressure-distributing undergarment depicted in FIGS. 1A, 1B, and 1C, for different percentage extensions at identified locations. For example, the modulus at upper chest band 103 is measured at 10% extension, 30% extension, 50% extension, and 80% extension. This data is repeated for all labelled components described in FIGS. 1A, 1B, and 1C above. A pre-stretch was applied to the example pressure-distributing undergarment before testing in order to ensure consistency throughout the process. Furthermore, it should also be noted that recovery of the pressure-distributing undergarment material was reviewed, and it achieved greater than ninety percent approval for recovery after resting between 1 and 30 minutes. As can be seen in the table, the modulus varies depending on the location in the pressure-distributing undergarment. For example, locations that are near the root of the breast have an increased modulus value, while other locations such as the straps and lower base band have a lower modulus value. In some embodiments, variation in modulus values may be achieved by introducing stiffer, higher powered material, for example, through knit intarsia or cut-and-sew construction techniques.

Figure 3A:
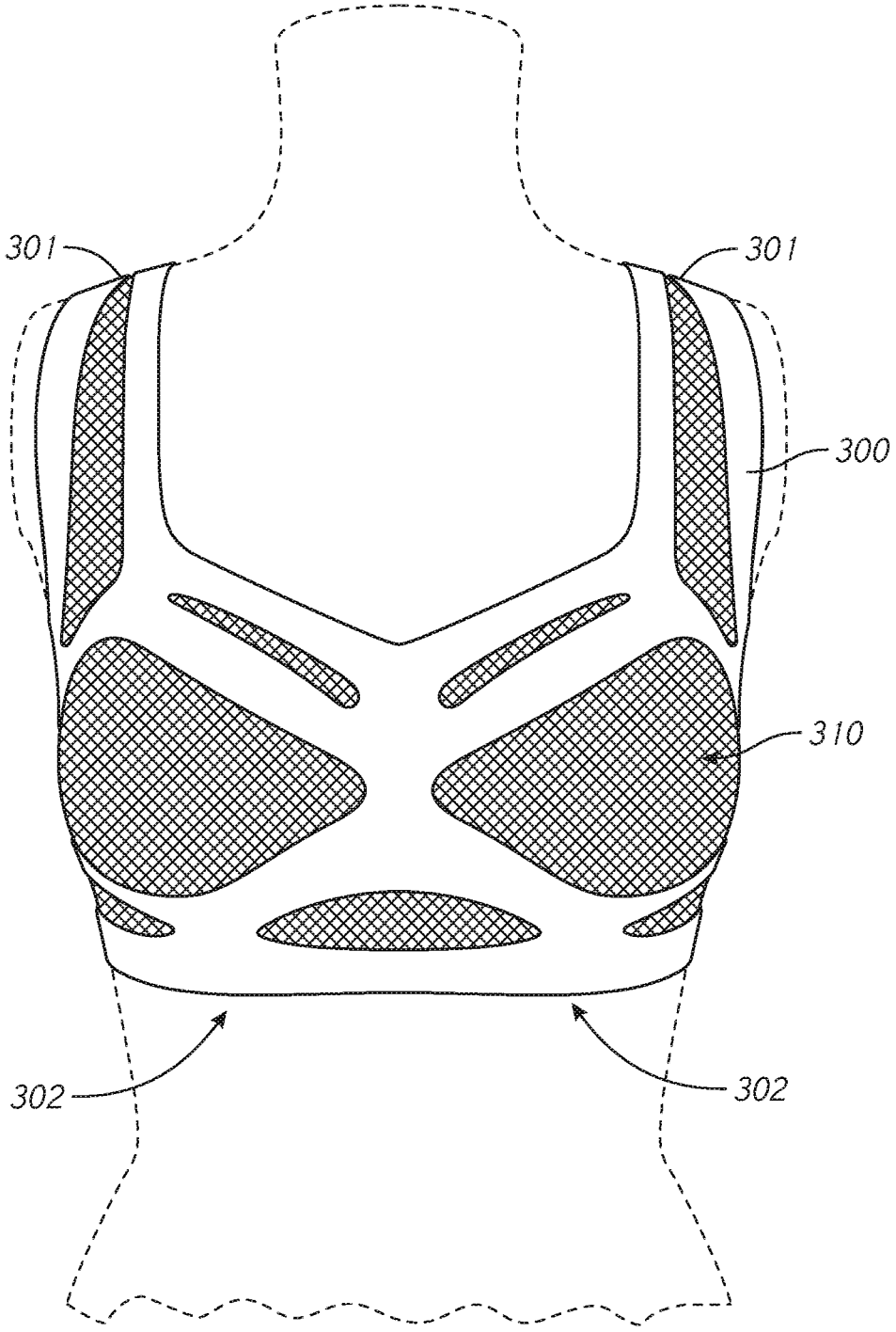
FIGS. 3A, 3B, and 3C depict example embodiments of a pressure-distributing undergarment over a secondary undergarment according to the invention.
Figure 3B:
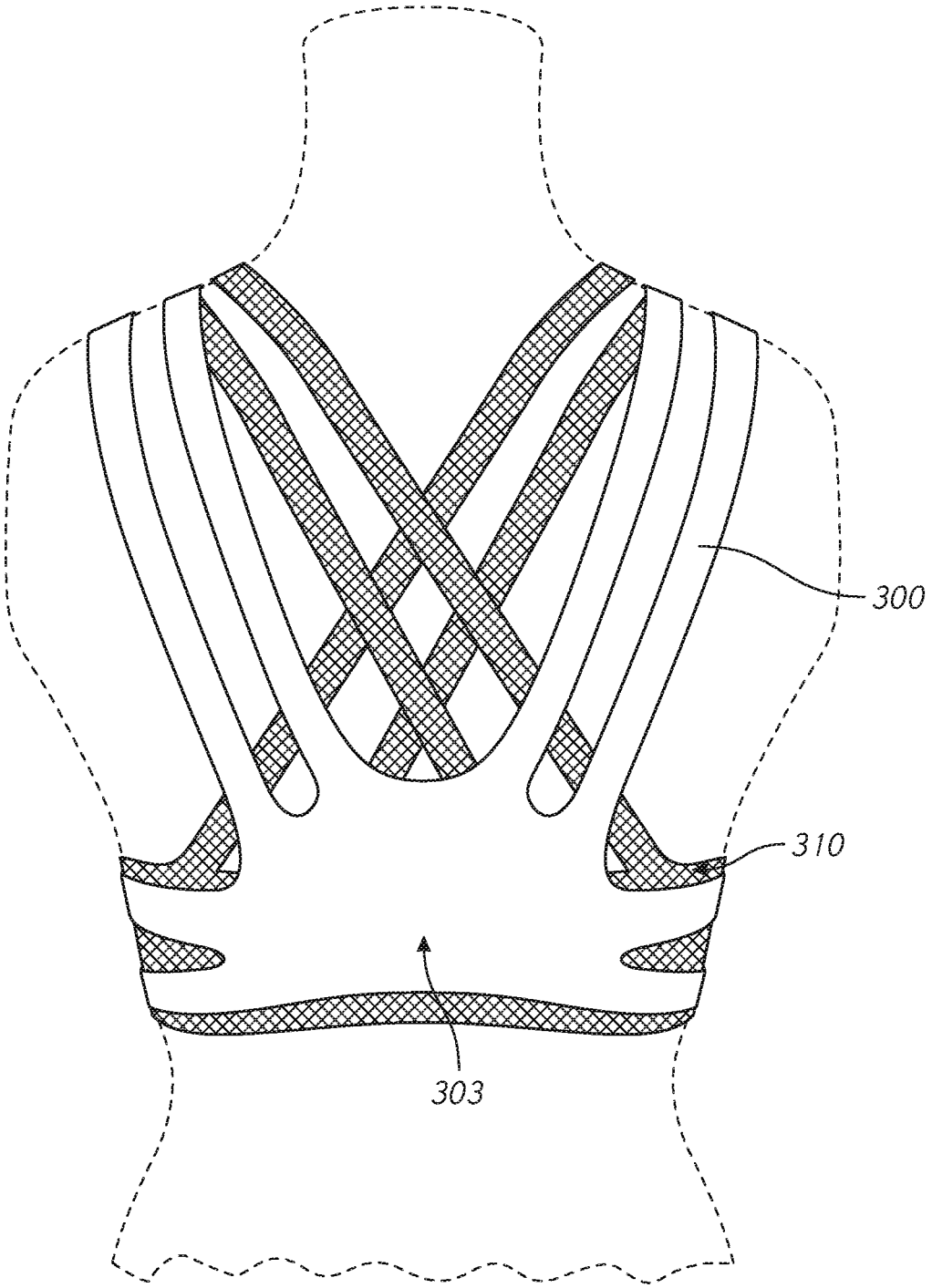
Figure 3C:
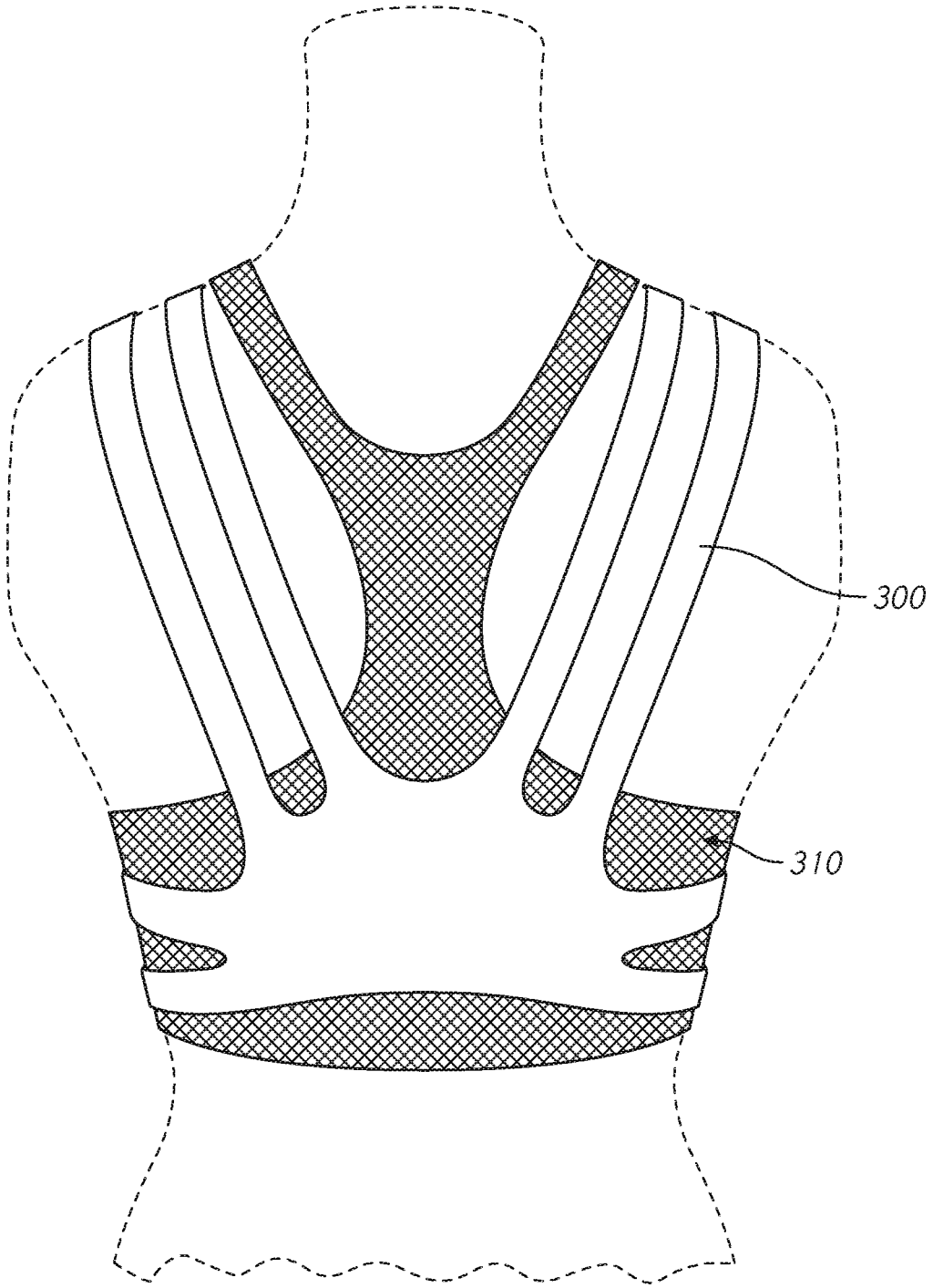

FIGS. 3A, 3B, and 3C depict pressure-distributing undergarment 300 in combination with secondary undergarment 310. Secondary undergarment 310 may be a medium to low support undergarment. Secondary undergarment 310 may be attached to pressure-distributing undergarment 300 at several discrete locations. These locations may include strap points 301, front points 302, and/or back center point 303. As described earlier, pressure-distributing undergarment 300 performs optimally when the breasts are decoupled, in order to allow independent breast movement. Pressure-distributing undergarment 300 also performs optimally when it is minimally fastened to secondary undergarment 310, such that the pressure-distributing undergarment and the secondary undergarment are substantially decoupled. As depicted in FIGS. 3B and 3C, the shoulder straps of the secondary undergarment may be arranged differently from those of the pressure-distributing undergarment, so that pressure is more evenly distributed across the wearer's shoulders and back.

Figure 4:
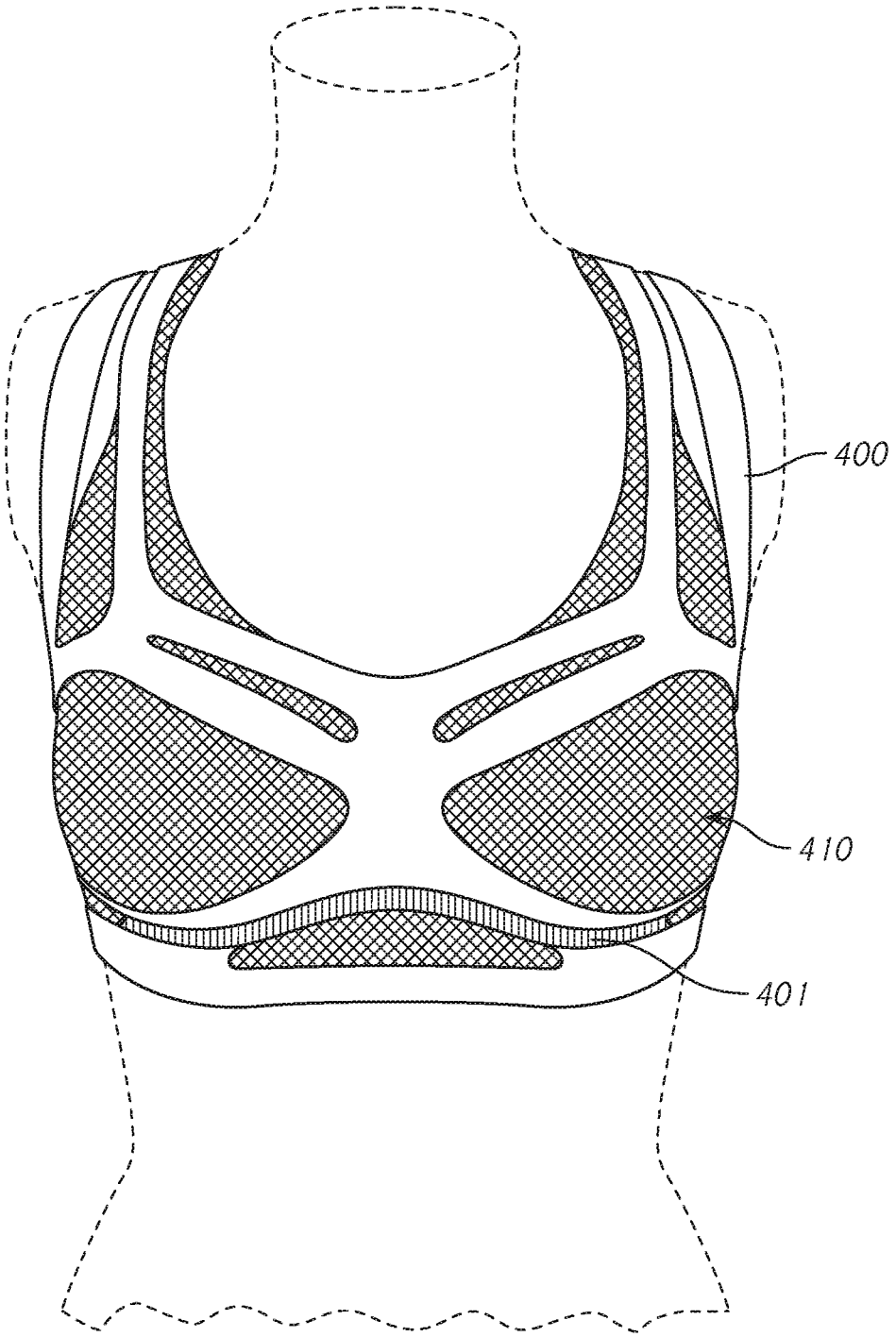
FIG. 4 depicts a pressure-distributing undergarment with lower border intarsia reinforcement in combination with a secondary undergarment according to the invention.

FIG. 4 depicts an embodiment of the invention where upper base band of pressure-distributing undergarment 400 is reinforced with lower border intarsia 401. Lower border intarsia 401 of a material with a higher power material property than the rest of the undergarment can also be integrated through a three-dimensional knitting process in order strengthen the upper base band at the lower root of the breast tissue. In this case, lower border intarsia 401 may be knit from a stiffer material than that of the rest of pressure-distributing undergarment 400. As depicted, and as described with respect to previous embodiments, intarsia-reinforced pressure-distributing undergarment 400 can be used in combination with secondary undergarment 410, which may be, for example, a low to medium support undergarment.

Figure 5:
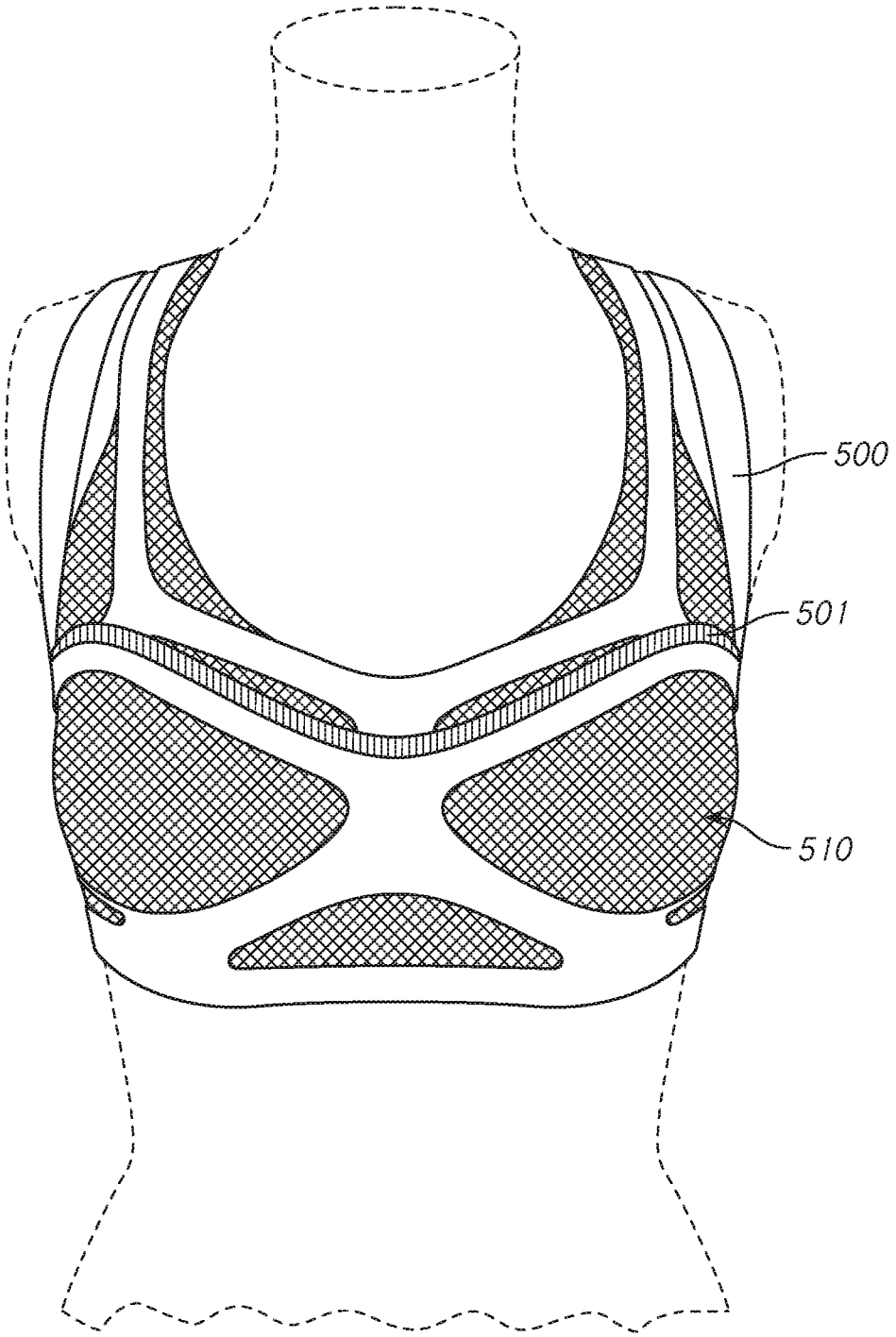
FIG. 5 depicts a pressure-distributing undergarment with upper border intarsia reinforcement in combination with a secondary undergarment according to the invention.

FIG. 5 depicts an embodiment of the invention where the lower chest band of pressure-distributing undergarment 500 is reinforced with upper border intarsia 501. As described with respect to FIG. 4, upper border intarsia 501 may be knit from a material that is has a higher power material property and is stiffer than that used for the rest of pressure-distributing undergarment 500. Also, as with previously described embodiments, intarsia-reinforced pressure-distributing undergarment 500 can be used in combination with secondary undergarment 510, and the two undergarments may be fastened together at discrete locations.

Figure 6:
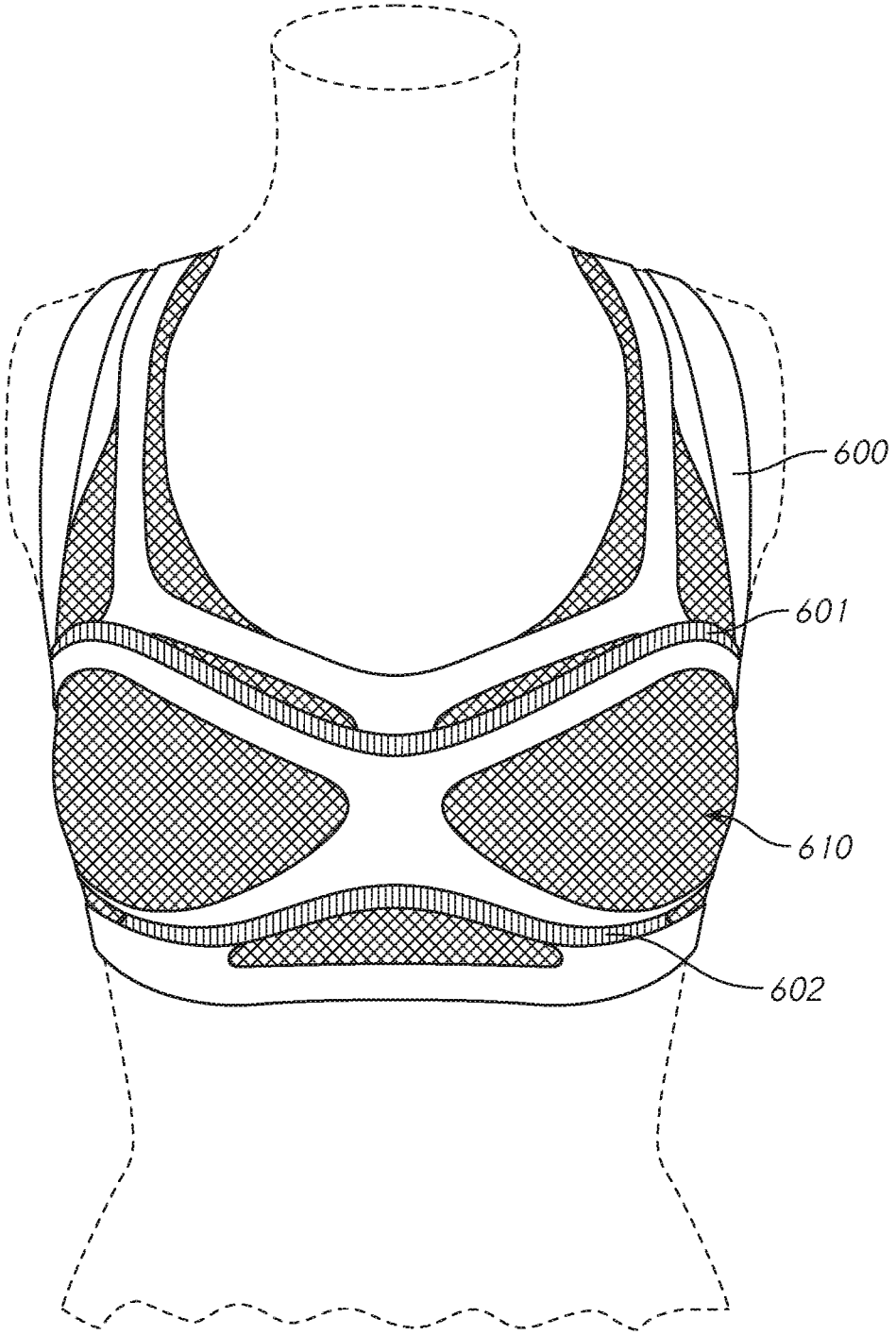
FIG. 6 depicts a pressure-distributing undergarment with upper and lower border intarsia reinforcement in combination with a secondary undergarment according to the invention.

FIG. 6 depicts an embodiment of the invention where both lower chest band 601 and upper base band 602 of pressure-distributing undergarment 600 are reinforced with intarsia. As described above with respect to other embodiments, these intarsias may be knit from a stiffer material with a higher power material property that reinforces these areas of pressure-distributing undergarment 600. Also, as with previously described embodiments, intarsia-reinforced pressure-distributing undergarment 600 can be used in combination with a secondary undergarment 610, and the two undergarments may be fastened together at discrete points.

Figure 7:
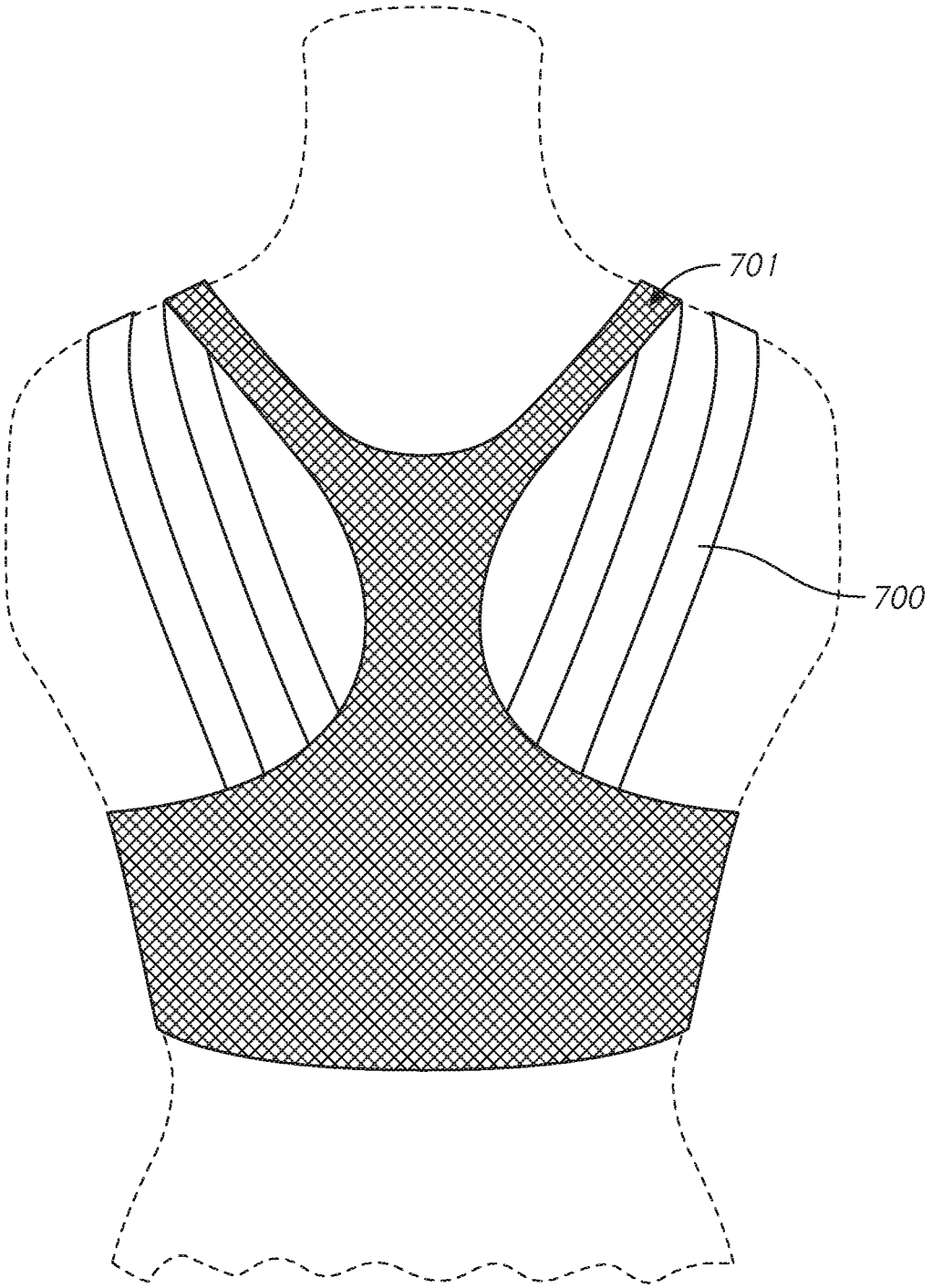
FIG. 7 depicts a rear view of a secondary undergarment over a pressure-distributing undergarment according to the invention.

FIG. 7 depicts a rear view of a pressure-distributing undergarment 700 according to the invention. In this embodiment, secondary undergarment 710 may be layered over pressure-distributing undergarment 700. The front view of this embodiment may include intarsia reinforcements, as described with respect to other embodiments above. Furthermore, secondary undergarment 710 may be fastened to pressure-distributing undergarment 700 at discrete points, as described with respect to embodiments above. Finally, as depicted in other embodiments, pressure-distributing undergarment 700 and secondary undergarment 710 may have different shoulder strap arrangements, in order to distribute the load effectively and reduce pressure on the wearer's back and shoulders.

While the above embodiments have relied upon intarsia to reinforce certain bands and straps in the pressure-distributing undergarment, it should be noted that alternative methods of strengthening these areas may be employed as well. For example, in a cut-and-sew construction, stiffer fabric may be sewn into areas for which there is desired reinforcement. It should also be noted that alternative configurations of the depicted undergarments, such as alternative back and shoulder strap arrangements, are contemplated in this application, and within the scope of the embodiments of the invention described herein.

Although a number of example embodiments of the invention have been described, it should be understood that numerous other modifications and embodiments of the invention can be devised by those skilled in the art that will fall within the scope of the principles of this disclosure. More particularly, various variations and modifications are possible in the component parts and/or arrangements of the inventive subject matter within the scope of the disclosure, the drawings, and the appended claims. In addition to variations and modifications in the component parts and/or arrangements, alternative uses and applications of the invention will also be apparent to those skilled in the art.

What is claimed is:

1. A pressure-distributing article of apparel comprising:

an undergarment comprising a chest band, a base band, a lower base band, and a pair of shoulder straps, wherein the undergarment includes knit intarsia;

wherein the chest band and the base band are configured to support breast tissue directly around a root of the breast tissue in a first amount;

wherein the first amount of support is greater than a second amount of support provided by the under band of the undergarment;

wherein the first amount of support is greater than a third amount of support provided by the shoulder straps of the undergarment; and wherein the undergarment is configured to allow the wearer's breasts to move independently from one another.

2. The article of apparel according to claim 1, wherein at least a portion of the undergarment is constructed using three-dimensional knitting.

3. The article of apparel according to claim 1, wherein the knit intarsia is configured to be located around the root of the wearer's breast.

4. The article of apparel according to claim 1 comprising:

a secondary undergarment attached at discrete points to the undergarment, wherein the secondary undergarment is configured to provide uniform support to the wearer's breast tissue.

5. The article of apparel according to claim 4, wherein the discrete points include shoulder positions, at least one front base position, or at least one back base position.

6. The article of apparel according to claim 4, wherein the undergarment and the secondary undergarment are substantially decoupled.

7. The article of apparel according to claim 4, wherein the undergarment is configured to be worn over the secondary undergarment.

8. The article of apparel according to claim 4, wherein the secondary undergarment is configured to be worn over the undergarment.

9. The article of apparel according to claim 1, wherein portions of the undergarment are reinforced through cut-and-sew construction.

10. A system for managing accelerating movements of breast tissue comprising:

a first garment constructed with materials of varying moduli, wherein material with higher modulus values are configured to be adjacent to a root of the breast tissue; and a second garment attached at discrete locations to the first garment, wherein the first garment comprises a chest band, a base band, a lower base band, and a pair of shoulder straps; and wherein the first garment includes intarsia-reinforced portions.

11. The system of claim 10, wherein the second garment is constructed of materials having substantially uniform modulus.

12. The system of claim 10, wherein at least a portion of the first garment is constructed using three-dimensional knitting.

13. The system of claim 10, wherein the first garment and second garment are substantially decoupled.

14. The system of claim 10, wherein the first garment is configured to be worn over the second garment.

15. The system of claim 10, wherein the second garment is configured to be worn over the first garment.

16. The system of claim 10, wherein shoulder straps of the first garment are configured differently than shoulder straps of the second garment.

17. The system of claim 10, wherein portions of the first garment are reinforced through cut-and-sew constructions.

18. A method for controlling movement of breast tissue of an individual:

applying a first level of pressure through a chest band and base band configured to surround a root of each of a first and second breast of the individual; and applying pressure at a level less than the first level to the individual's torso in areas other than the root of each breast through a pair of shoulder straps and a lower base band wherein the chest band, base band, shoulder straps, or lower base band includes an intarsia-reinforced portion.

19. The method of claim 18, further comprising supporting the root of each of the first and second breast of the individual such that the first and second breast are substantially decoupled.

20. The method of claim 18 wherein the first level of pressure is applied by material of higher modulus than material used to apply used to apply a lower level of pressure.

* * * * *